United States Patent [19]

Lorenz et al.

[11] Patent Number: 4,602,894

[45] Date of Patent: Jul. 29, 1986

[54] COMBINATION OFFSHORE DRILLING RIG

[75] Inventors: David B. Lorenz; John S. Laird, II, both of Houston, Tex.

[73] Assignee: Marathon Manufacturing Company, Houston, Tex.

[21] Appl. No.: 739,165

[22] Filed: May 30, 1985

Related U.S. Application Data

[63] Continuation of Ser. No. 259,713, May 1, 1981, abandoned.

[51] Int. Cl.[4] ..... E02B 17/00; B63B 35/00

[52] U.S. Cl. ..... 405/203; 405/196; 175/7

[58] Field of Search ..... 405/195–201, 405/203–208; 175/5, 7

[56] References Cited

U.S. PATENT DOCUMENTS

| | | | |
|---|---|---|---|
| 2,589,146 | 3/1952 | Samuelson | 405/208 |
| 3,001,594 | 9/1961 | Suderow | 405/201 X |
| 3,014,346 | 12/1961 | Small | 405/198 |
| 3,201,945 | 8/1965 | Sutton | 405/196 |
| 3,477,235 | 11/1969 | Branham et al. | 405/201 |
| 3,830,071 | 8/1974 | LeTourneau | 405/197 |
| 3,986,368 | 10/1976 | Levington | 405/196 |
| 3,999,396 | 12/1976 | Evans | 405/203 X |
| 4,065,934 | 1/1978 | Dysarz | 405/196 |
| 4,161,376 | 7/1979 | Armstrong | 405/201 X |
| 4,208,158 | 6/1980 | Davies et al. | 405/201 X |
| 4,255,069 | 3/1981 | Yielding | 405/196 |
| 4,269,542 | 5/1981 | Mueller | 405/196 |
| 4,269,543 | 5/1981 | Goldman et al. | 405/198 |
| 4,445,805 | 5/1984 | Ray et al. | 405/195 |

*Primary Examiner*—Donald L. Taylor
*Attorney, Agent, or Firm*—Vinson & Elkins

[57] ABSTRACT

A combination offshore drilling rig which combines the desirable features of a slot-type drilling rig and a cantilever-type drilling rig while eliminating the limitations and undesirable features associated with either type of such rigs. The combination offshore drilling rig mounts the derrick and drilling equipment on a movable cantilever structure which may be positioned over a slot of sufficient area to permit the drilling operation to be carried out through the slot or may be moved outboard of the peripheral boundary of the rig hull to perform a drilling or workover operation outside the peripheral boundary of the rig hull.

9 Claims, 8 Drawing Figures

A
B
G
H
D
20
12
18
C
15
15
12
B
B 18
19
17
10
D
B
12
B
H
A
S

COMBINATION OFFSHORE DRILLING RIG

This is a continuation of application Ser. No. 259,713 filed May 1, 1981, now abandoned.

This invention relates to new and useful improvements in offshore drilling rigs.

BACKGROUND OF THE INVENTION

The usual jack-up offshore drilling rig includes a barge hull and supporting legs which are capable of being operated to jack up the hull above the surface of the water. One type of rig unit, generally known as the slot-type, provides a slot in the aft end of the hull and located inside of the peripheral boundary of said hull. The derrick and drilling equipment are permanently mounted above the slot so that the drill pipe which is suspended from the derrick in the usual manner extends through such slot. The drilling equipment which includes the rotary table and other necessary machinery is not capable of being skidded or moved outboard of the periphery of the drilling barge and therefore can never be employed to be extended outwardly to a position which is outboard of the vessel. For this reason, the slot-type rig cannot be employed for the purpose of either drilling a production well or for working over an existing well when said wells are located outside the peripheral boundary of the barge hull. One example of an offshore slot-type offshore drilling rig is illustrated in the patent to Samuelson Pat. No. 2,589,146.

A second type of jack-up offshore drilling rig is known as the cantilever type rig and includes a structure which can be skidded or moved outwardly beyond the peripheral boundary of the barge hull. By reason of being capable of such movement, the cantilever-type rig may be employed to drill exploratory wells or to be skidded out over an existing platform which is located beyond the hull periphery. The primary disadvantage of a cantilever-type rig is that in a storm or very severe weather conditions the extended cantilever structure must be retracted inwardly onto the upper surface of the barge. An example of prior art cantilever-type rigs are shown in the prior patent to Suderow Pat. No. 3,001,594 and in the photograph of a rig owned by the Crestwave Offshore Services, Inc. which appears on page 3930 of the *Composite Catalog of Oilfield Equipment and Services,* 1968–1969 edition of Volume 3.

OBJECTS OF THE INVENTION

It is one object of the invention to provide an offshore drilling platform which provides a combination of the desirable features of a slot-type drilling rig and a cantilever-type drilling rig while eliminating the limitations and undesirable features associated with either type of such drilling rigs.

It is an important object of the invention to arrange and locate a cantilever-type structure with respect to a drilling slot of a drilling barge hull whereby the derrick and associated drilling equipment carried by the cantilever structure may be utilized to drill through the slot, at which time the cantilever would be inboard of the periphery of the hull, or to extend the cantilever structure outwardly so that drilling or other operations may be carried out on a well location which is outboard of the peripheral boundary of the hull.

A further object of the invention is to provide a combination offshore drilling rig which permits the rig to be utilized either as a slot-type or a cantilever-type rig and which has the control mechanism and necessary hold down means for the cantilever structure so disposed in relation to the drilling slot that a normal drilling operation may be carried out through the slot without interference from said mechanism and means.

DESCRIPTION OF THE PREFERRED EMBODIMENT

Figure 1:
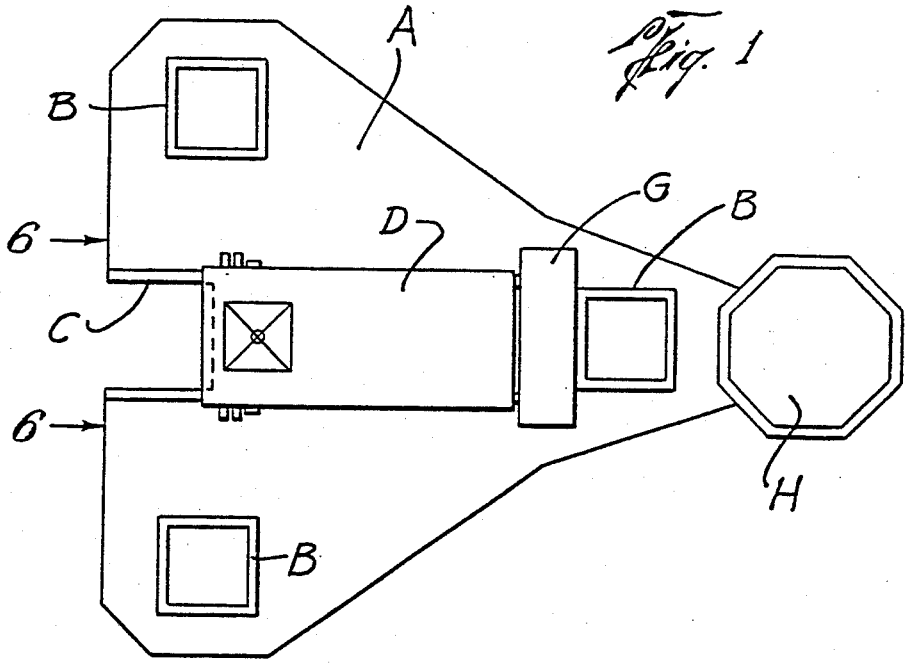
FIG. 1 is a schematic plan view of a drilling rig constructed in accordance with the invention and with the cantilever structure in a retracted position, the usual necessary pumps and other equipment being omitted for the sake of clarity.
Figure 2:
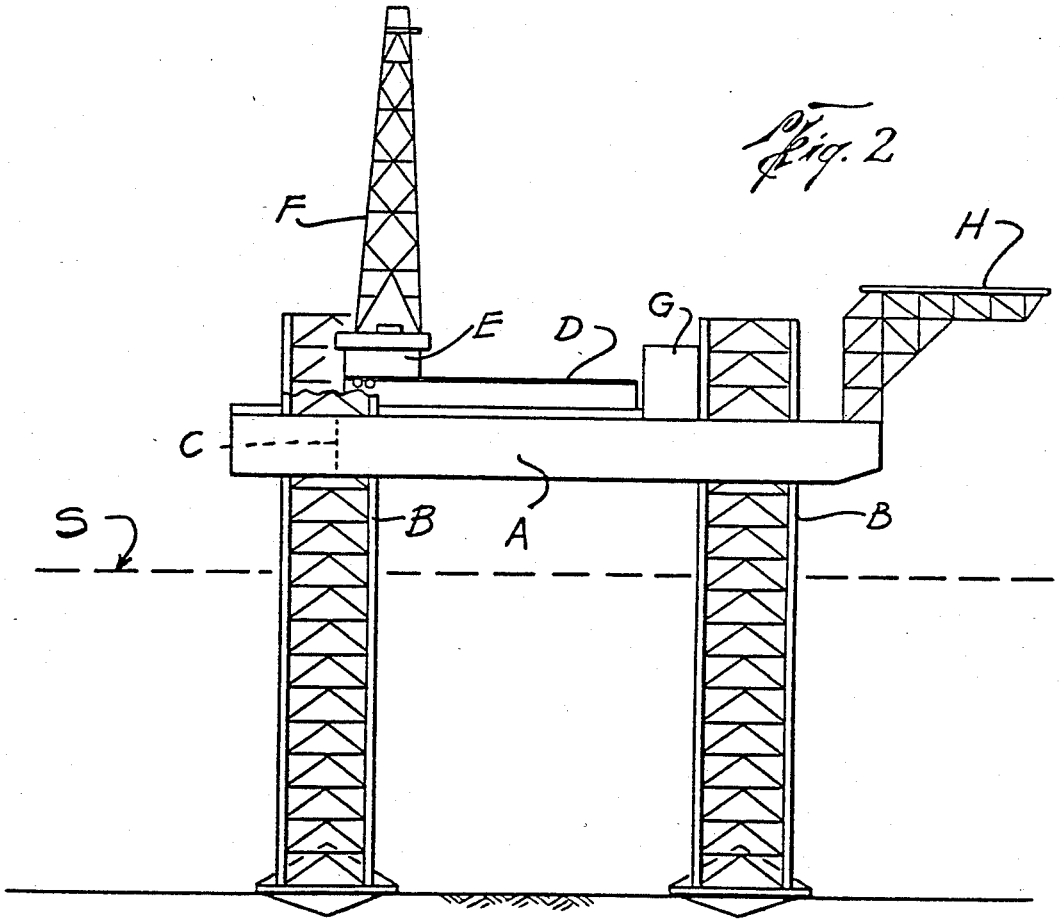
FIG. 2 is a schematic side elevation of the rig shown in FIG. 1.

In the drawings, the letter A designates the hull of an offshore drilling rig having a trio of supporting legs or columns B which are capable of raising the hull above the surface S of the water so that a drilling operation may be carried out. The hull, its supporting legs and the jack-up mechanism are all well known in the art. The hull is formed with a drilling slot C in the central portion of its aft area and a cantilever structure D is movably supported on the upper surface of the hull. A substructure E is mounted at one end of the cantilever D and a derrick F of usual construction is supported on said substructure. The substructure also carries the usual rotary table and other drilling equipment necessary in the drilling of a well.

For the sake of clarity, the usual pipe racks, mud pumps, tanks and other machinery and equipment normally carried on the deck of the hull A have been omitted. However, the living quarters G are located near the forward portion of the hull as is a helicopter pad H. As noted, the structure of the hull, its supporting legs and all necessary machinery and equipment are well known in the offshore drilling rig art and it will be understood that all such machinery and equipment will be mounted and located on the barge in the usual manner.

Figure 6:
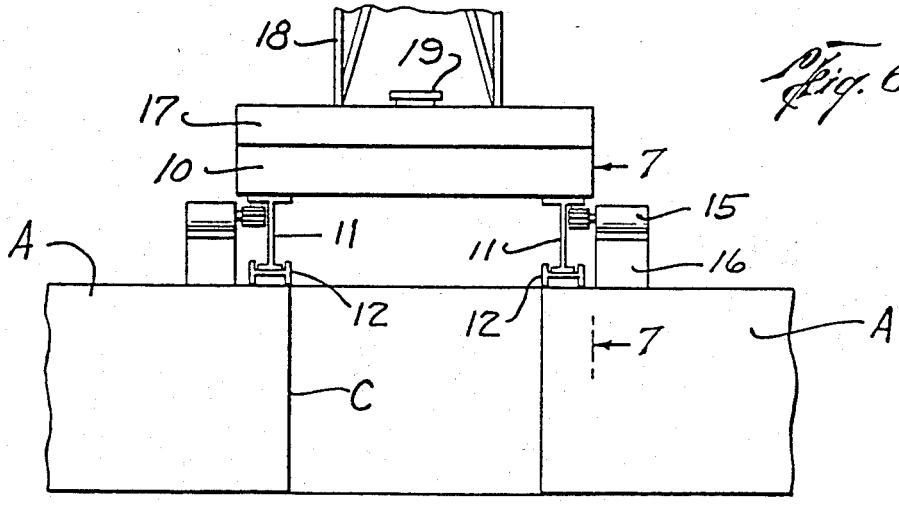
FIG. 6 is a view of the cantilever assembly and its supporting structure, viewed from line 6—6 of FIG. 1.
Figure 7:
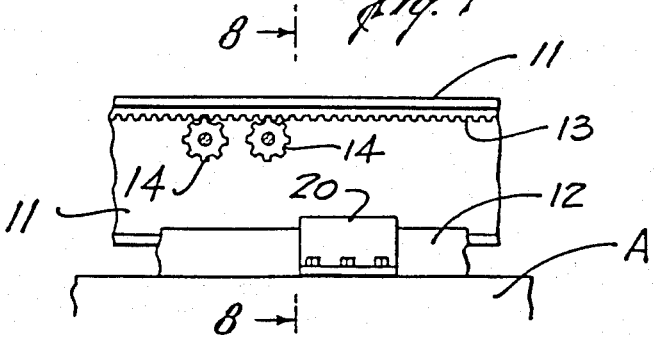
FIG. 7 is a partial, sectional view taken on the line 7—7 of FIG. 6.

Referring specifically to the cantilever structure D which is shown in more detail in FIGS. 6 and 7, said structure includes a sub-base member 10 which is supported upon spaced I-beams 11 which are movable along tracks 12 secured to the hull A. Each supporting I-beam is provided with an elongate gear rack 13 adapted to be engaged by drive gears or pinions 14 which are rotated by electric motors 15. Each motor is supported upon a bracket 16 which has its lower portion secured to the upper surface of the hull A.

As shown in FIG. 7, the pinions 14 are mounted in spaced relationship on each side of the cantilever structure and when said drive pinions are rotated by their respective motors, the cantilever structure is moved longitudinally with respect to the barge hull. The sub-base 10 which is secured to the upper surface of the I-beams or skids supports a substructure 17 upon which the derrick 18 and the usual rotary table 19 (FIG. 6) are mounted. All other drilling equipment and machinery is also supported by the substructure and although not shown for purposes of clarity, it will be understood that such equipment is in proper position to function as needed in a well drilling or a well clean-out operation.

Figure 8:
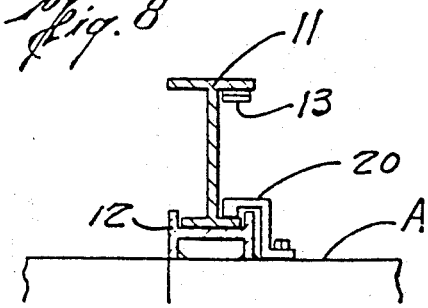
FIG. 8 is a detail view of one of the hold down members associated with the cantilever structure.

To maintain the I-beam supports or skids upon their respective rails in all positions of the cantilever structure with respect to the hull, hold down clamps 20 one of which is shown in FIG. 8, are provided. It is preferable that a single clamp which has been found adequate be located on each side of the cantilever structure D. Each clamp is bolted or otherwise secured to the upper surface of the hull A and is shaped to have its upper end overhang the outer portion of each rail 12 and the outer flange of each I-beam 11 in the manner shown in FIG. 8. The hold down means functions to maintain the cantilever structure in position on its tracks in all positions of the structure with respect to the hull.

Figure 3:
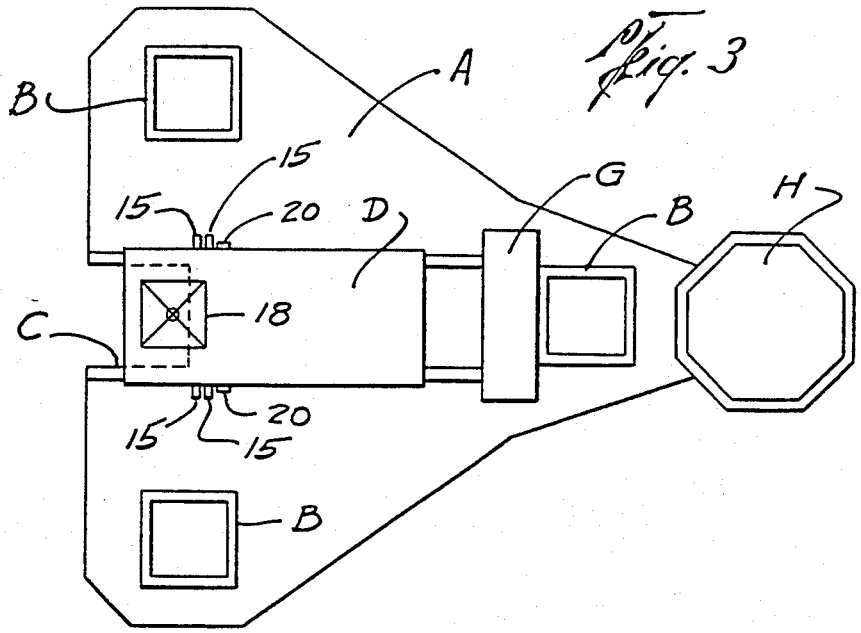
FIG. 3 is a plan view similar to FIG. 1 and showing the cantilever structure moved to a position where the derrick and its associated equipment may be utilized to drill through the drilling slot in the barge hull.
Figure 4:
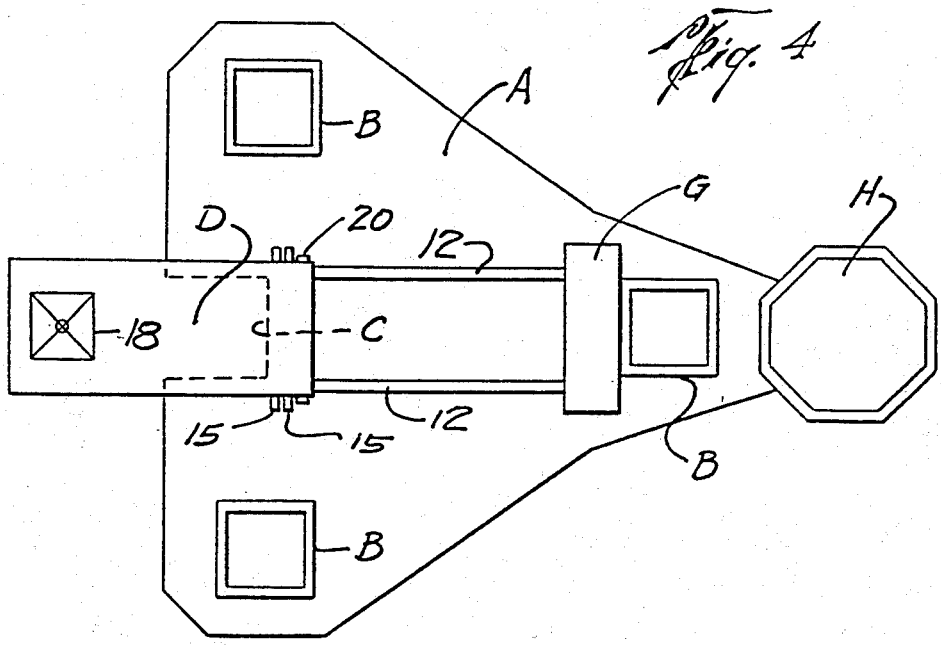
FIG. 4 is a view similar to FIGS. 1 and 3 and showing the cantilever structure in an extended position locating the derrick and its drilling equipment outside the peripheral boundary of the barge hull.

The cantilever structure D is normally in its fully retracted position as shown in FIG. 1. This is its non-working location and is so located when the rig is being towed. The cantilever structure is movable from the position of FIG. 1 to a fully extended position as shown in FIG. 4. It is also capable of being moved to the intermediate position shown in FIG. 3 which locates the derrick and the rotary table in alignment with the slot C in the aft end of the hull. The drilling slot C has its open end at the periphery of the barge hull and is of such area as to substantially match the size of the derrick floor. This assures that any type of usual operation may be carried out through the slot. The drive motors 15 which control the movement of the cantilever structure are disposed in a position inwardly of the end of the drilling slot C whereby such motors will not interfere with drilling operations when such operations are being carried out through the drilling slot C. It is also preferable to locate the hold down clamps 20 inwardly of the motors to assure that said clamps will be engaged with the inboard end of the cantilever structure when such structure is in its fully extended position as shown in FIG. 4. Thus, the hold down clamp will assure that there will be no overbalancing of the cantilever structure when it is working in its extended position.

From the foregoing, the advantages and operation of the combination drilling rig heretofore described are obvious. When the barge hull is under tow, the legs B are of course raised and at this time, the cantilever structure D is in its retracted position (FIG. 1).

If it is desired to drill through the slot which would be determined primarily by whether or not severe weather conditions may be encountered, the rig is moved to location and the legs are lowered to jack-up the hull A. Thereafter, the motors 15 are operated to move the cantilever structure to the intermediate position (FIG. 3) to locate the derrick and rotary table over the drilling slot C. Drilling may then commence and continue with the cantilever in this position. If weather conditions become severe the unit may remain in place and it is not necessary to move the cantilever structure from its intermediate position over the drilling slot since it is fully supported within the confines of the hull. Upon the weather conditions moderating, drilling can immediately continue.

Figure 5:
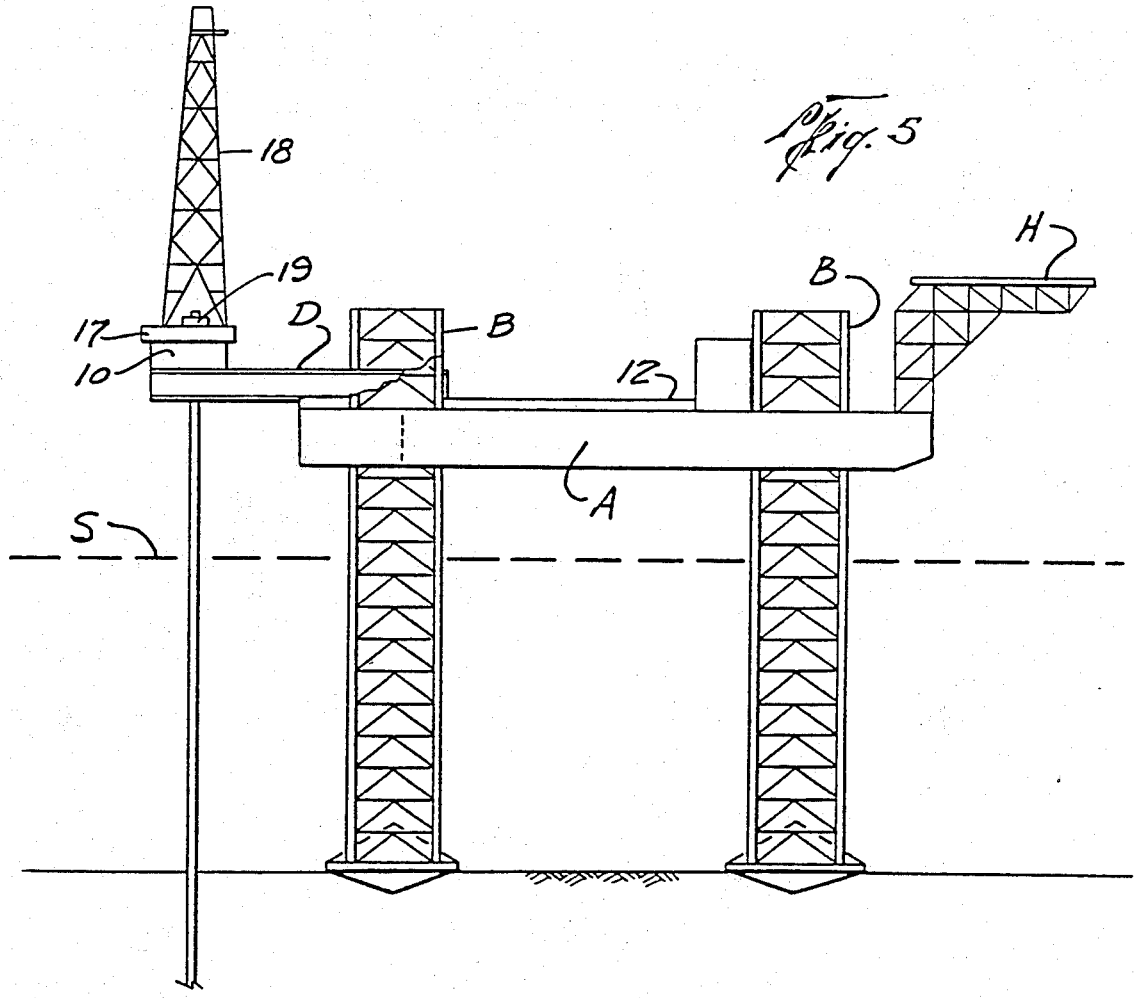
FIG. 5 is a schematic side elevation of the rig as shown in FIG. 4.

If it is desired to drill an exploratory well or to work over an existing well outside of the periphery of the hull, then the cantilever structure D will be moved to the position shown in FIG. 4 which is its fully extended position. In this position, the derrick and associated drilling equipment is disposed outside the peripheral boundary of the hull A (FIG. 5). So long as severe weather conditions are not encountered, drilling may continue with the cantilever in this extended position. However, if weather conditions become so severe that drilling has to be discontinued, the cantilever structure D is retracted onto the upper surface of the hull. Obviously, the extended position of the cantilever structure will permit the derrick and its associated equipment to be located over a producing platform in which case, work over operations may be carried out on the existing well. It is evident that if the cantilever structure is secured to a permanent production platform then the weather would have to be very severe before the cantilever would have to be retracted. Thus, in work over operations where a permanent production platform is in place, it is possible that operations might continue except in the most violent weather.

From the foregoing, it will be seen that a combination offshore drilling rig is provided. By arranging the cantilever structure D in the proper relationship to a drilling slot C, the operator has a choice of operating through the drilling slot C or extending the cantilever to an outboard position and performing operations outside of the peripheral boundary of the hull A. The drilling rig is extremely versatile and can be operated in the particular position which is most advantageous for the work being done.

What is claimed is:

1. An offshore drilling rig for use in drilling into a formation below a body of water comprising a barge hull having a drilling slot extending inwardly from the peripheral boundary of the barge hull, means for supporting the barge hull in a position above the water, a cantilever structure mounted on the barge hull and movable horizontally with respect to such barge hull, said cantilever structure being so located relative to the drilling slot as to be movable horizontally into a position in vertical alignment with said drilling slot, a derrick and drilling machinery mounted to said cantilever structure and movable into a position above said drilling slot whereby well drilling operations may be conducted through said drilling slot, said cantilever structure also being movable horizontally to a position which locates the derrick and the drilling machinery outboard of the peripheral boundary of the barge hull, whereby a drilling operations may be conducted outside of said peripheral boundary of said barge hull, means mounted on the barge hull for moving said cantilever structure horizontally to different positions relative to the barge hull, means mounted on the barge hull co-acting with the cantilever structure for anchoring the cantilever structure inboard of the peripheral boundary of the barge hull, whereby the cantilever structure, the derrick and the drilling machinery may be positioned outboard of the peripheral boundary of the barge hull without requiring additional support, and said means for moving said cantilever structure and said means for anchoring said cantilever structure being so located on the barge hull so that they do not interfere with any operations to be conducted through said drilling slot or to be performed outboard of the peripheral boundary of the barge hull.

2. An offshore drilling rig as set forth in claim 1, wherein the means for supporting the barge hull comprises vertical leg members, and a jacking mechanism disposed between said leg members and the barge hull whereby said barge hull may be jacked upwardly or downwardly to locate the barge hull in the desired position relative to the surface of the water.

3. An offshore drilling rig as set forth in claim 1, wherein said means for moving said cantilever structure may move said structure, derrick and drilling machinery completely inboard of the barge hull and out of alignment with said drilling slot.

4. An offshore drilling rig as set forth in claim 1, wherein the means for moving said cantilever structure horizontally comprises, a longitudinally gear rack mounted on each side of the cantilever structure, drive pinions on each side of the cantilever structure engageable with the gear racks, a drive motor for each drive pinion supported on the barge hull and located inwardly of the drilling slot, said motors operating said drive pinion to move the cantilever structure in a desired manner, and said gear racks, drive pinions and motor being located on the rig floor so as not to interfere with the movement of the cantilever structure.

5. An offshore drilling rig as set forth in claim 1, wherein the means for movably mounting the cantilever structure comprises, a pair of spaced parallel tracks mounted on the barge hull deck and located one on each side of the drilling slot, and a pair of skid supporting elements secured to the underside of the cantilever structure and slidable along said tracks when the means for moving said structure is actuated.

6. An offshore drilling rig as set forth in claim 5, wherein the means for anchoring said cantilever structure comprises a pair of hold down clamps mounted on the barge hull deck and located one on each side of the drilling slot, each of said pair of hold down clamps co-acting respectively with each of said pair of skid supporting elements to hold each respective skid supporting element to its respective spaced parallel track.

7. An offshore drilling rig comprising a barge hull having a drilling slot in the central portion of one end thereof, a cantilever structure mounted on the upper surface of said barge hull and movable horizontally with respect to the barge hull, a derrick mounted on said cantilever structure in a substantially vertical position with respect to said cantilever structure and drilling equipment carried by said cantilever structure, means mounted on the deck of the barge hull for moving the cantilever structure to a position to vertically align the derrick and drilling equipment with the drilling slot to permit operations to be carried out through said drilling slot, said means for moving said cantilever structure also being capable of moving said cantilever structure to an extended position to locate the derrick and drilling equipment outboard of the peripheral boundary of the barge hull to permit operations to be carried out at a location outside of the peripheral boundary of the barge hull, and means mounted on the barge hull co-acting with the cantilever structure to secure that portion of the cantilever structure that is inboard of the barge hull to said hull to anchor said cantilever structure requires no additional support when in said extended position.

8. An offshore drilling rig as set forth in claim 7, together with vertical legs associated with the barge hull, and means for supporting said barge hull on said vertical legs above the surface of the water when drilling and other operations are in progress.

9. An offshore drilling rig as set forth in claim 7, wherein said means for moving said cantilever structure comprises a gear rack secured to the cantilever structure, a driven pinion engageable with said gear rack, and motor means secured to the barge hull for rotating said drive pinion to thereby move said gear rack in said cantilever structure, said motor means and said drive pinion being positioned on the barge hull inwardly of the inner end of said drilling slot, whereby said means for moving said cantilever structure does not interfere with operations being performed through said drilling slot or being performed outboard of the peripheral boundary of the barge hull.

* * * * *